United States Patent [19]

Seike et al.

[11] Patent Number: 4,689,445

[45] Date of Patent: Aug. 25, 1987

[54] PORCELAIN ELECTRICAL INSULATOR RESISTANT TO DESTRUCTION BY PROJECTILES

[75] Inventors: Shoji Seike; Takao Totoki; Akio Kaneko, all of Nagoya, Japan

[73] Assignee: NGK Insulators, Ltd., Japan

[21] Appl. No.: 796,777

[22] Filed: Nov. 12, 1985

[30] Foreign Application Priority Data

Sep. 13, 1985 [JP] Japan ..... 60-201836

[51] Int. Cl.[4] ..... H01B 17/02

[52] U.S. Cl. ..... 174/212; 174/182

[58] Field of Search ..... 174/165, 182, 188–200, 174/202–206, 210–212

[56] References Cited

U.S. PATENT DOCUMENTS

| | | | |
|---|---|---|---|
| 2,383,090 | 8/1945 | Torok | 174/196 X |
| 3,141,063 | 7/1964 | Edwards | 174/212 |

FOREIGN PATENT DOCUMENTS

| | | | |
|---|---|---|---|
| 201693 | 4/1956 | Australia . | |
| 213655 | 3/1924 | United Kingdom | 174/186 |
| 296673 | 11/1929 | United Kingdom | 174/182 |
| 766230 | 1/1957 | United Kingdom | 174/179 |
| 926544 | 5/1963 | United Kingdom | 174/182 |
| 978501 | 12/1964 | United Kingdom | 174/212 |
| 1148977 | 4/1969 | United Kingdom | 174/212 |

*Primary Examiner*—Laramie E. Askin

*Attorney, Agent, or Firm*—Parkhurst & Oliff

[57] ABSTRACT

A porcelain electrical insulator resistant to destruction by projectiles comprises a shed and a head portion protrusively and integrally formed with the shed. The thinnest part of the shed is not less than 5 mm, and the thickness of the head portion which is to be covered with a cap or the thickness of the insulator in the vicinity of the junction portion between the head portion and the shed is not less than 2 times the minimum thickness of the shed.

6 Claims, 11 Drawing Figures

PORCELAIN ELECTRICAL INSULATOR RESISTANT TO DESTRUCTION BY PROJECTILES

BACKGROUND OF THE INVENTION

1. Field of the Invention

The present invention relates to an electrical insulator. More specifically, the invention relates to an electrical insulator wherein when the insulator is impacted with a projectile and a shed is broken, a crack does not extend to a head portion thereof. Thus, for example, no reduction in power supply or line drop occurs. Such an electrical insulator preferably consists essentially of alumina.

2. Related Art Statement

An example of a heretofore known ceramics suspension insulator is shown in FIG. 10. Typically, such an insulator has a thickness a of a head portion 51 which is to be covered with a cap approximately the same as the thickness b of a shed 52.

When the above conventional suspension insulator made of ceramic is used in power transmission lines and a projectile fired from, for example, a hunting gun impacts upon the shed, a crack extends not only to the shed but also to the head portion. In some cases, the suspension insulator is scatteringly broken so that the insulator will not fully perform its function. As a result, there occurs a drop of the power transmission line and interruption of the power supply results, which may cause unexpected serious disasters. Recently, such accidents have successively occurred particularly in North America, South America, Australia, etc., where high power projectiles are used in hunting.

SUMMARY OF THE INVENTION

An object of the present invention is to obviate the aforesaid defects and to provide an electrical insulator having an excellent resistance to high speed projectiles such as a bullet from a gun. The electrical insulator ameliorates the disadvantages of the above-mentioned insulators while maintaining sufficient electrical and mechanical integrity of the insulator. More particularly, the insulator is manufactured such that when the insulator is shot with a projectile, a possible crack does not extend to a head portion, resulting in the insulator being able to maintain sufficient mechanical and electrical characteristics.

According to the present invention, there is a provision of an electrical insulator in which the thickness of the thinnest part of a shed is not less than 5 mm, and either the thickness of a head portion to be covered with a cap or the thickness in the vicinity of the junction portion between the head portion and the shed is not less than 2 times the minimum thickness of the shed.

According to a preferred embodiment of the present invention, there is a provision of the electrical insulator in which the thickness of the insulator in the vicinity of the junction portion between the head portion and the shed is equal to the thickness from the tip of a projection between a pin hole into which a steel pin is to be inserted and fixed and the innermost recess portion to the external surface of the shed.

According to another preferred embodiment of the present invention, there is a provision of the electrical insulator in which the thickness of the insulator in the vicinity of the junction between the head portion and the shed is the thickness of the shed between the bottom portion of the innermost recess and the external surface of the shed.

According to still another preferred embodiment of the present invention, there is a provision of the electrical insulator in which the thickness of the insulator in the vicinity of the junction between the head portion and the shed is equal to the thickness of a projection between a pin hole in which a steel pin is to be inserted and fixed and the innermost recess.

According to a further preferred embodiment of the present invention, there is a provision of the electrical insulator in which the length of ribs in the insulator are not less than 3 times the minimum thickness of the shed.

According to a still further preferred embodiment of the present invention, there is a provision of the electrical insulator which is made of an insulating material having an alumina content of not less than 40% by weight.

BRIEF DESCRIPTION OF THE DRAWINGS

For better understanding of the invention, reference is made to the attached drawings, wherein.

Figure 1:
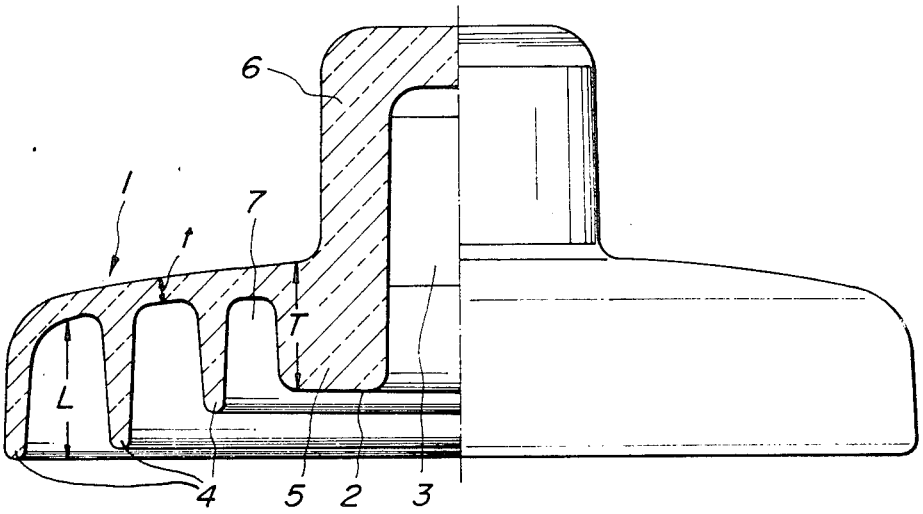
FIGS. 1, 2, 2A, 3 and 4 are partially sectional views of embodiments of the electrical insulators according to the present invention.

Throughout the drawings, 1, 11, 21, 31, 52 denote a shed, 2, 22 a tip of a projection, 3, 23 a pin hole, 4, 12, 24, 33 ribs, 5, 13, 25 a projection 6, 14, 27, 32, 51 a head portion, 7, 28 a recess, 15 a bottom portion of a recess, 26 a stepped portion, 41 a suspension insulator, 42 a ground surface, 43 a projectile orbit, and 44 a rifle.

DETAILED DESCRIPTION OF THE INVENTION

In the present invention, the thickness of the insulator in the vicinity of the junction between the head portion and the shed denotes any one of the thickness from the tip end of a projection between a pin hole to which a steel pin is to be inserted and fixed and the innermost recess to the external surface of the shed, the thickness of the shed between the bottom portion of the innermost recess portion and the external surface of the shed, and the thickness of the projection between the pin hole into which the steel pin is to be inserted and fixed and the innermost recess portion.

The length of the outermost rib, preferably the length of all the ribs, is not less than three times the minimum thickness of the shed, and the content of alumina is preferably in a range not less than 40% by weight.

The reasons for the numerical limitations will be described later, and are briefly explained here.

The reason why the minimum thickness of the shed is not less than 5 mm is that if it is less than 5 mm, the mechanical strength and the electrical characteristics of the insulator may be deteriorated. The reason why the thickness of the head portion which is to be covered with a cap or the thickness of the insulator in the vicinity of the junction between the head portion and the shed is not less than 2 times the minimum thickness of the shed is that if the former is less than 2 times, a crack may extend to the head portion when the insulator is shot by a projectile. Consequently, the shot insulator cannot fully perform its function. The reason why, preferably, the length of the rib is not less than 3 times the minimum thickness of the shed and the content of alumina is not less than 40% by weight is that these parameters increase the mechanical strength of the insulator and reduce the rate at which cracks extend to the head portion.

By so constructing, even if the insulator is shot by a projectile, any stress caused by the impact of the projectile is concentrated upon the thinnest part of the shed and therefore breaks the thinnest part so that any extension of the cracks to the head portion is prevented.

Consequently, an insulator which is free from cracking at the head portion, that is, free from a reduction in mechanical strength and a reduction of electrical characteristics of the head portion, can be obtained.

The present invention will be described more in detail while referring to specific embodiments, which are merely illustrative of the invention, but should not be interpreted to limit the scope thereof.

(EXAMPLES)

Ceramic raw materials, shown by way of an example in Table 1, are prepared, and wet ground and mixed by means of a ball mill or the like, followed by filterpressing to obtain cakes. The thus obtained cakes are extruded preferably by a de-airing extruder and molded into a desired shape. The green body is molded into such a shape in which the minimum thickness of the shed and the thickness of the head or the vicinity of the junction between the head portion and the shed falls within the numerically limited ranges respectively, while the thickness of the shed and the length of the rib may be set at specific values. After the molded green body is fully dried and glazed, the glazed body is fired in the temperature range from 1,250° to 1,450° C. A cap is applied to the head portion of the fired insulator and a steel pin is secured into the pin hole by means of cement to assemble a suspension insulator.

TABLE 1

| Chemical component | $SiO_2$ | $Al_2O_3$ | $Fe_2O_3$ | $TiO_2$ | CaO | MgO | $K_2O$ | $Na_2O$ |
|---|---|---|---|---|---|---|---|---|
| Range (% by weight) | 25.0~75.0 | 18.0~68.0 | 0.1~1.5 | 0.1~1.0 | 0.1~1.0 | 0.05~1.0 | 1.0~6.0 | 0.5~3.0 |
| Preferred range (% by weight) | 26.0~55.0 | 40.0~65.0 | 0.1~0.7 | 0.1~0.4 | 0.1~0.4 | 0.05~0.4 | 3.0~6.0 | 1.0~2.5 |

FIGS. 1 through 4 are partially sectional views of embodiments of electrical insulators according to the present invention. In the embodiment illustrated in FIG. 1, the minimum thickness t of the shed is 5 mm, and the thickness of the insulator in the vicinity of the junction between the head portion 6 and the shed 1, that is, the thickness T of the thickened part from the tip portion 2 of a projection 5, formed between a pin hole 3 into which a steel pin (not shown) is to be inserted and fixed and a recess portion 7 inside of the innermost rib 4, to the external surface of the shed 1 is set at 15 mm, and the length L of the outermost rib 4 is 10 mm.

Figure 2:
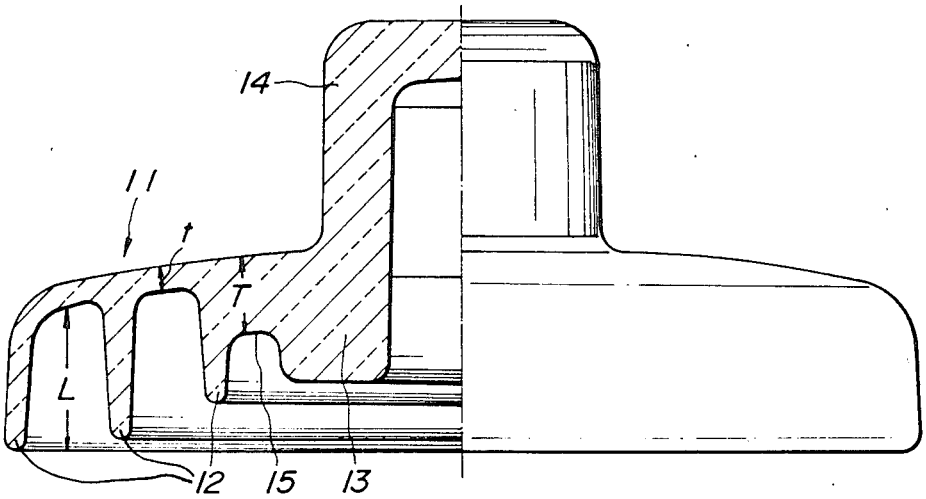

FIG. 2 shows an embodiment in which the minimum thickness t of the shed 11 is 5 mm, the thickness of the insulator in the vicinity of the junction between the head portion 14 and the shed 11, that is, the thickness T of the thickened part from the bottom portion 15 of a recess between the projection 13 and the innermost rib 12 to the external surface of the shed 11 is 10 mm, and the length L of the outermost rib 12 is 25 mm.

Figure 2A:
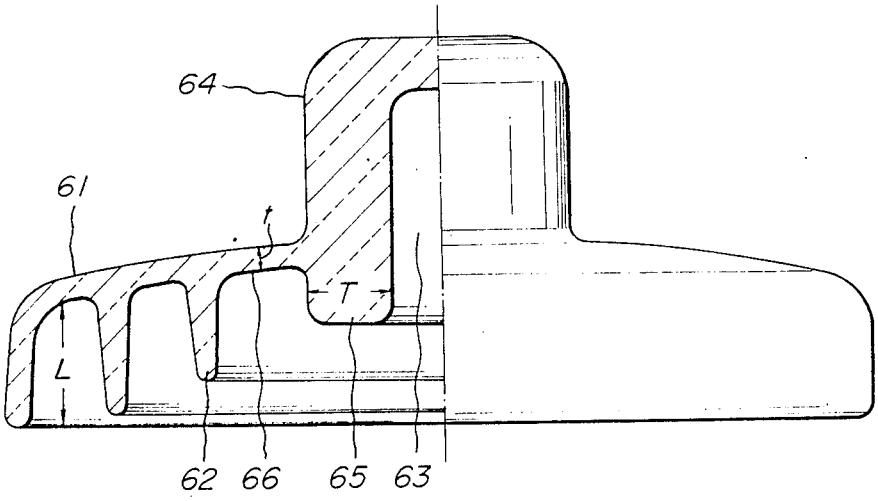

FIG. 2A shows an embodiment similar to FIGS. 1 and 2, wherein the reference characters T, t and L have the same meaning as in the other Figures. The numeral 61 denotes a shed portion, 62 represents a radially innermost rib, 63 represents a pin hole, 64 denotes a head portion, 65 is the thickened portion of the shed having a thickness T and 66 is the minimum thickness of the shed having a thickness t.

Figure 3:
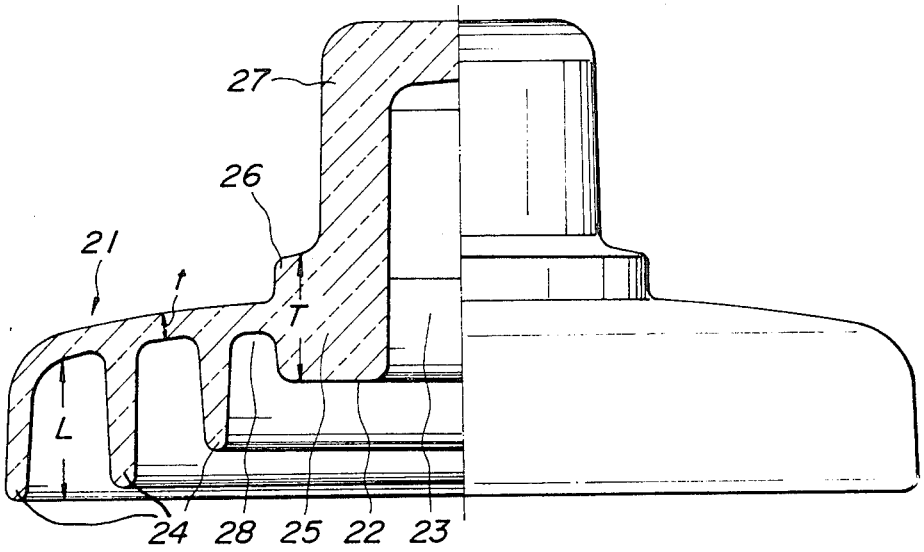

FIG. 3 shows an embodiment in which the minimum thickness t of the shed 21 is 15 mm, the thickness of the insulator in the vicinity of the junction between the head portion 27 and the shed 21, that is, the thickness T of the thickened part from the tip 22 of a projection 25 between the pin hole 23 and the recess 28 inside of the innermost rib 24 to a stepped portion 26 formed on the external surface of the shed 21 is 30 mm, and the length L of the outermost rib 24 is 45 mm.

Figure 4:
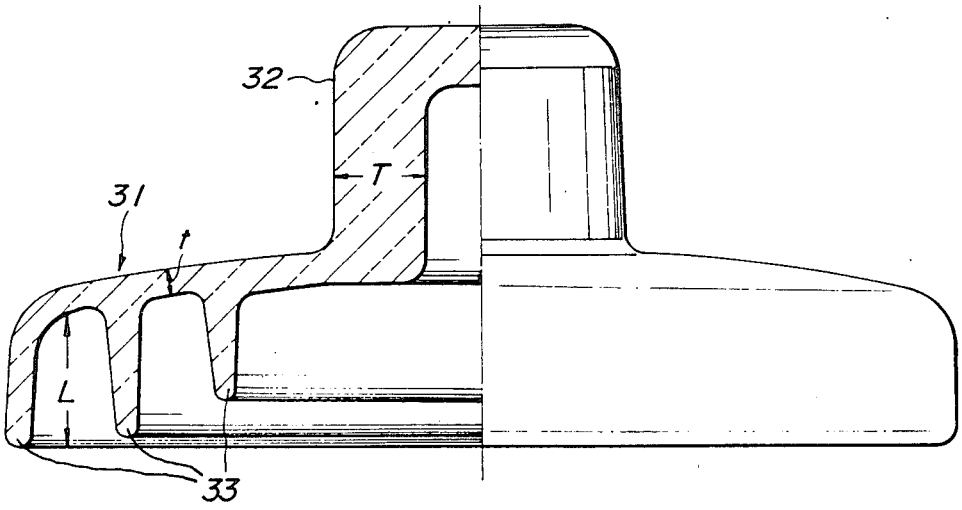

FIG. 4 shows an embodiment in which the minimum thickness t of the shed is 15 mm, the thickness T of the head portion is 30 mm, and the length L of the outermost rib 33 is 30 mm.

Figure 5:
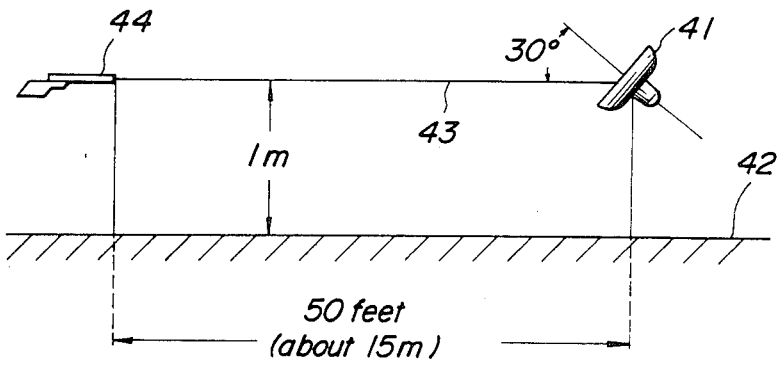
FIG. 5 is a schematic view illustrating a shooting test method carried out in the present invention.

In order to quantitatively grasp, for example, the resistance to high speed projectiles of the above-mentioned electrical insulators according to the present invention, the following shooting tests were carried out. That is, in FIG. 5, which shows a schematic view of the shooting test, a suspension insulator 41 to be tested is upwardly set at a position 1 m above the ground surface 42 at an angle of 30° with respect to a projectile orbit 43. A projectile is shot from a rifle 44 spaced 50 feet (about 15 m) from the suspension insulator 41 and at the same level as the insulator. The projectile is directed to the bottom of a recess portion between the outermost rib and the outermost but one rib. The projectiles used and gun used were 222 REM projectiles (projectile speed: 957 m/s, energy: 151 kg.m), a Savage 222 REM long, rifle gun model 340.

As the judgement criteria of the resistance of the insulator to high speed projectiles, the amount of shed broken off and the percentage (%) of head portions which were cracked were used. The criterion for evaluating the amount of shed broken off after shooting is defined by the following equation:

Amount of shed broken off (%) =

-continued $$\frac{\text{shed weight before shooting} - \text{weight of the remaining shed after shooting}}{\text{shed weight before shooting}} \times 100$$

The cracked percentage of the head portion is a criterion for judging whether the insulator tested is to be unsuitable or not, depending upon the extension of cracks produced at the impact point and extending into the head portion, and is determined by the following equation through decomposing the shot insulator, the insulator being judged "to be unsuitable" whenever a crack extends to the head portion over the edge of the cap, and as "to be acceptable" whenever a crack does not extend to the head portion over the edge of the cap.

Cracked percentage of head portion (%) =

$$\frac{\text{Insulator number of cracks extended to the head portion}}{\text{total number of insulators}} \times 100$$

EXAMPLE 1

Figure 6:
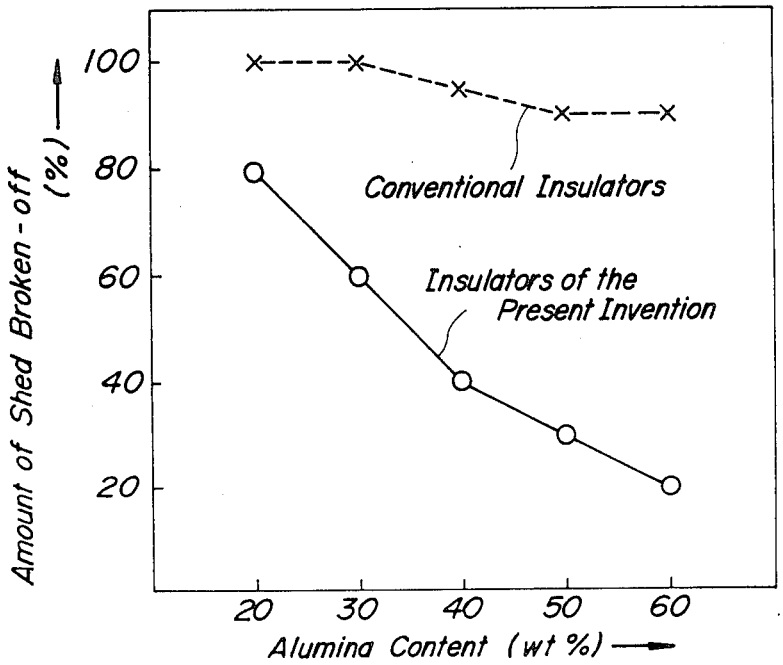
FIG. 6 is a graph showing the relation between the content of alumina and amount of shed broken off in a high power projectile shooting.
Figure 10:
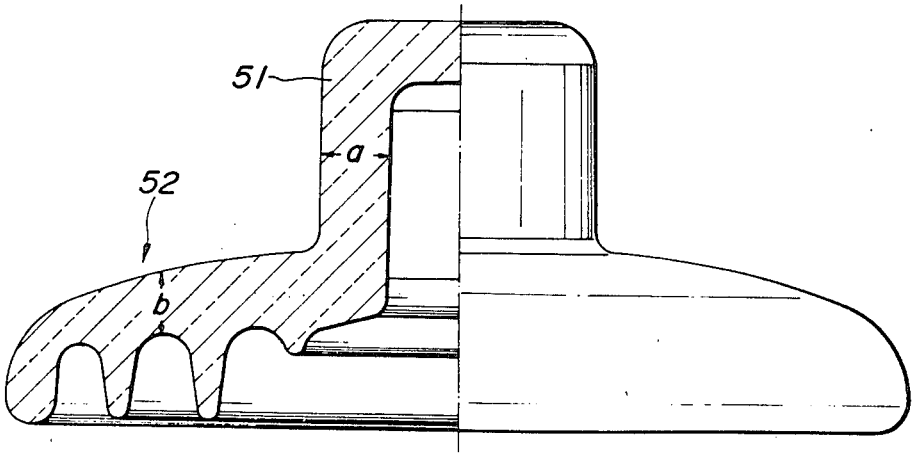
FIG. 10 PRIOR ART
FIG. 10 is a partially sectional view showing a conventional electrical insulator.

With respect to raw materials in which the content of alumina ($Al_2O_3$) among the chemical components shown in Table 1 was varied from 20 to 65% by weight, suspension insulators according to the present invention having the respective profiles shown in FIGS. 1 to 4 and a suspension insulator having a conventional profile shown in FIG. 10 were prepared. The above-mentioned shooting tests were carried out by using high power projectiles with respect to each of the thus prepared suspension insulators. Results are shown in Table 2, and the relation between the amount of shed broken off after the shooting test and the content of alumina is shown in FIG. 6. In the total evaluation, x, ○, and ◎ denote "unsuitable", "tolerable in actual application" although cracks are partially observed, and "no cracks", respectively.

according to the present invention is shot, a stress concentration due to the projectile impact occurs at the boundary between the thinnest part of the shed and the thickened portion in the head or in the vicinity of the junction between the head portion and the shed, thereby breaking the thinnest part of the shed and at the same time separating the thinnest part of the shed from the thickend portion, so that a crack produced through such an impact can be prevented from extending to the head portion. Further, the larger the content of alumina, the greater the resistance to high speed projectiles. To the contrary, in the conventional insulator of FIG. 10, cracks extend to the head portion, and the insulator was so broken that it could not function as an insulator. As evident from FIG. 6, the insulator of the specific profile according to the present invention with the larger content of alumina has a smaller amount of shed broken off, and exhibits more conspicuous effects.

EXAMPLE 2

Figure 7:
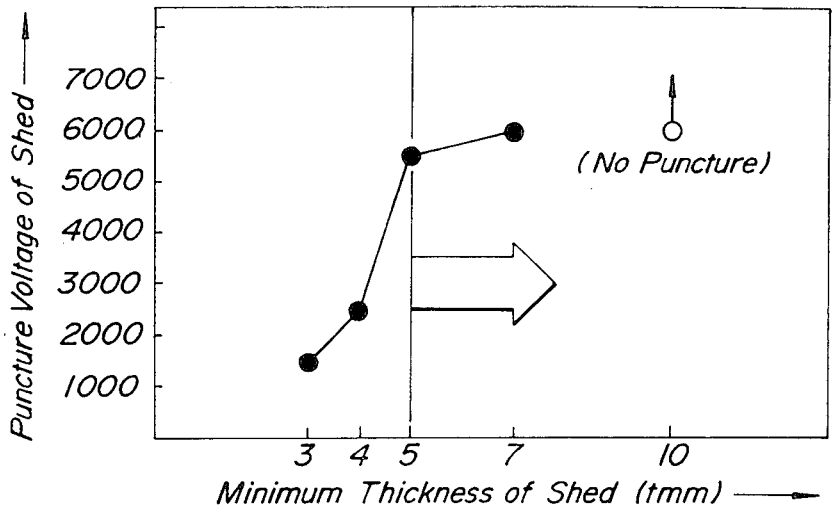
FIG. 7 is a graph showing the relation between the thickness of a shed and the puncture voltage of the shed according to the present invention.

Suspension insulators which had the material in the composition range shown in Table 1 and the profile shown in FIG. 1 while the minimum thickness of the shed being varied in a range from 3 to 10 mm were prepared. The puncture voltage of the shed was evaluated by using the thus obtained suspension insulators. This was done to determine the thickness level of the thinnest part of the shed which poses no practical problem, because abnormal high voltage may be applied onto the shed in a rare case such as lightning striking the actual line. The evaluation of the minimum thickness of the shed under the high voltage is performed by the instantaneous application of a high voltage between the cap and the pin after assembly, and measuring the thickness at which an electric current is passed through the thinnest part of the shed. FIG. 7 shows results thereof. As evident from the results of FIG. 7, if the minimum thickness of the shed is less than 5 mm, the electric insulating property against the high voltage tends to be drastically reduced. Similar tests were carried out with respect to the suspension insulators having the profiles

TABLE 2

| Items | Insulators of the present invention | | | | | | | | | | | | | | | | | | | | Conventional insulators | | | | |
|---|---|---|---|---|---|---|---|---|---|---|---|---|---|---|---|---|---|---|---|---|---|---|---|---|---|
| Experiment No. | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Profile | shown in FIG. 1 | | | | | shown in FIG. 2 | | | | | shown in FIG. 3 | | | | | shown in FIG. 4 | | | | | shown in FIG. 10 | | | | |
| Minimum thickness of shed (t mm) | 5.0 | | | | | 5.0 | | | | | 15.0 | | | | | 15.0 | | | | | 14.4 | | | | |
| Thickness of the thickened part (T. mm) | 15.0 | | | | | 10.0 | | | | | 30.0 | | | | | 30.0 | | | | | 20.0 | | | | |
| T/t | 3.0 | | | | | 2.0 | | | | | 2.0 | | | | | 2.0 | | | | | 1.4 | | | | |
| Rib length (L mm) | 10.0 | | | | | 25.0 | | | | | 45.0 | | | | | 30.0 | | | | | 25.6 | | | | |
| L/t | 2.0 | | | | | 5.0 | | | | | 3.0 | | | | | 2.0 | | | | | 1.8 | | | | |
| Alumina content (wt %) | 20 | 30 | 40 | 50 | 60 | 20 | 30 | 40 | 50 | 60 | 25 | 35 | 45 | 55 | 65 | 25 | 35 | 45 | 55 | 65 | 20 | 30 | 40 | 50 | 60 |
| Head portion cracked rate (%) | 10 | 0 | 0 | 0 | 0 | 0 | 0 | 0 | 0 | 0 | 0 | 0 | 0 | 0 | 0 | 20 | 10 | 0 | 0 | 0 | 100 | 100 | 100 | 100 | 100 |
| Total evaluation | ○ | ◎ | ◎ | ◎ | ◎ | ◎ | ◎ | ◎ | ◎ | ◎ | ◎ | ◎ | ◎ | ◎ | ◎ | ○ | ○ | ◎ | ◎ | ◎ | x | x | x | x | x |

As is obvious from Table 2, it was revealed that the profile-improved suspension insulator according to the present invention in which the thin portion is formed in the shed, and the thickened portion is provided in the head portion or in the vicinity of the junction between the head portion and the shed, is extremely effective in that when the suspension insulator is shot by a high power gun, a crack does not extend to the head portion. When the shed of the insulator with the specific profile in FIGS. 2 to 4, and substantially the same results were obtained.

EXAMPLE 3

Figure 8:
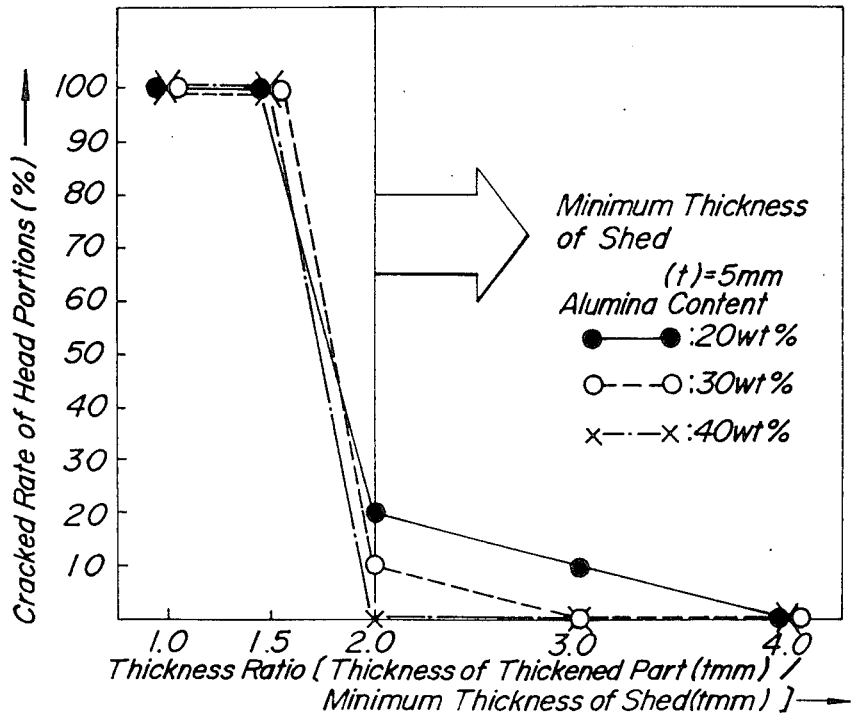
FIG. 8 is a graph showing the relation between the thickness ratio thickness of a thickened part to a minimum thickness of the shed and the cracked rate of the head portions.

While the minimum thickness of the shed was kept constant and only the thickness of the thickened part of the head portion or the vicinity of the junction between the head portion and the shed was varied, with respect to the material of the composition range shown in Table 1 and the profile shown in FIG. 1, the limit of the thickness ratio (thickness of the thickened portion/minimum thickness of the shed) at which cracks did not extend to the head portion over the edge of the cap when projectiles shot from a gun impacted with the insulators was examined. The above-mentioned shooting test method was used, and tests were conducted by using high power projectiles. The evaluation of the insulator was carried out based on the above-mentioned cracked rate of the head portions. Table 3 and FIG. 8 show results thereof. As obvious from FIG. 8, it was revealed that when the thickness ratio of the thickness of the thickened portion of the head portion or in the vicinity of the junction between the head portion and the shed, to the minimum thickness of the shed is not less than 2 and the content of alumina is not less than 40% by weight, the cracks do not extend to the head portion even if the insulator is shot with a high power projectile. The reason is that the stress caused by the projectile impact is concentrated upon the boundary between the thinnest part of the shed and the thickened portion, so that the thinnest part of the shed is broken and at the same time the thinnest portion of the shed is separated from the thickened portion. The thickness ratio being not less than 2 can effectively accomplish the above effect. Similar tests were conducted with respect to suspension insulators having profiles shown in FIGS. 2 to 4, and substantially the same results could be obtained.

TABLE 3

| Items | Insulators of the present invention | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| Sample No. | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
| Profile | shown in FIG. 1 | | | | | | | | | | | | | | | | | | | | | | | | | | | | | |
| Minimum thickness of shed (t mm) | | | | | | | | 5.0 | | | | | | | | | | | | | | | 15.0 | | | | | | | |
| Length of outermost rib (L)/t | | | | | | | | 2.0 | | | | | | | | | | | | | | | 2.0 | | | | | | | |
| Thickened part (T mm) | | | 10.0 | | | | | 15.0 | | | | | 20.0 | | | | | 30.0 | | | | | 45.0 | | | | | 60.0 | | |
| T/t | | | 2.0 | | | | | 3.0 | | | | | 4.0 | | | | | 2.0 | | | | | 3.0 | | | | | 4.0 | | |
| Alumina content (wt %) | 20 | 30 | 40 | 50 | 60 | 20 | 30 | 40 | 50 | 60 | 20 | 30 | 40 | 50 | 60 | 20 | 30 | 40 | 50 | 60 | 20 | 30 | 40 | 50 | 60 | 20 | 30 | 40 | 50 | 60 |
| Head portion cracked rate (%) | 20 | 10 | 0 | 0 | 0 | 10 | 0 | 0 | 0 | 0 | 0 | 0 | 0 | 0 | 0 | 20 | 10 | 0 | 0 | 0 | 20 | 10 | 0 | 0 | 0 | 0 | 0 | 0 | 0 | 0 |
| Total evaluation | ○ | ○ | ◎ | ◎ | ◎ | ○ | ◎ | ◎ | ◎ | ◎ | ◎ | ◎ | ◎ | ◎ | ◎ | ○ | ○ | ◎ | ◎ | ◎ | ○ | ○ | ◎ | ◎ | ◎ | ◎ | ◎ | ◎ | ◎ | ◎ |

| Items | Reference insulators | | | | | | | | | | | | | | | | | | | | Conventional insulators | | | | |
|---|---|---|---|---|---|---|---|---|---|---|---|---|---|---|---|---|---|---|---|---|---|---|---|---|---|
| Sample No. | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 |
| Profile | shown in FIG. 1 | | | | | | | | | | | | | | | | | | | | shown in FIG. 10 | | | | |
| Minimum thickness of shed (t mm) | | | | | 5.0 | | | | | | | | | | 15.0 | | | | | | | | 14.4 | | |
| Length of outermost rib (L)/t | | | | | 2.0 | | | | | | | | | | 2.0 | | | | | | | | 1.8 | | |
| Thickened part (T mm) | | | 5.0 | | | | | 7.5 | | | | | 15.0 | | | | | 22.5 | | | | | 20.0 | | |
| T/t | | | 1.0 | | | | | 1.5 | | | | | 1.0 | | | | | 1.5 | | | | | 1.4 | | |
| Alumina content (wt %) | 20 | 30 | 40 | 50 | 60 | 20 | 30 | 40 | 50 | 60 | 20 | 30 | 40 | 50 | 60 | 20 | 30 | 40 | 50 | 60 | 20 | 30 | 40 | 50 | 60 |
| Head portion cracked rate (%) | 100 | 100 | 100 | 100 | 100 | 100 | 100 | 100 | 100 | 100 | 100 | 100 | 100 | 100 | 100 | 100 | 100 | 100 | 100 | 100 | 100 | 100 | 100 | 100 | 100 |
| Total evaluation | x | x | x | x | x | x | x | x | x | x | x | x | x | x | x | x | x | x | x | x | x | x | x | x | x |

EXAMPLE 4

Figure 9:
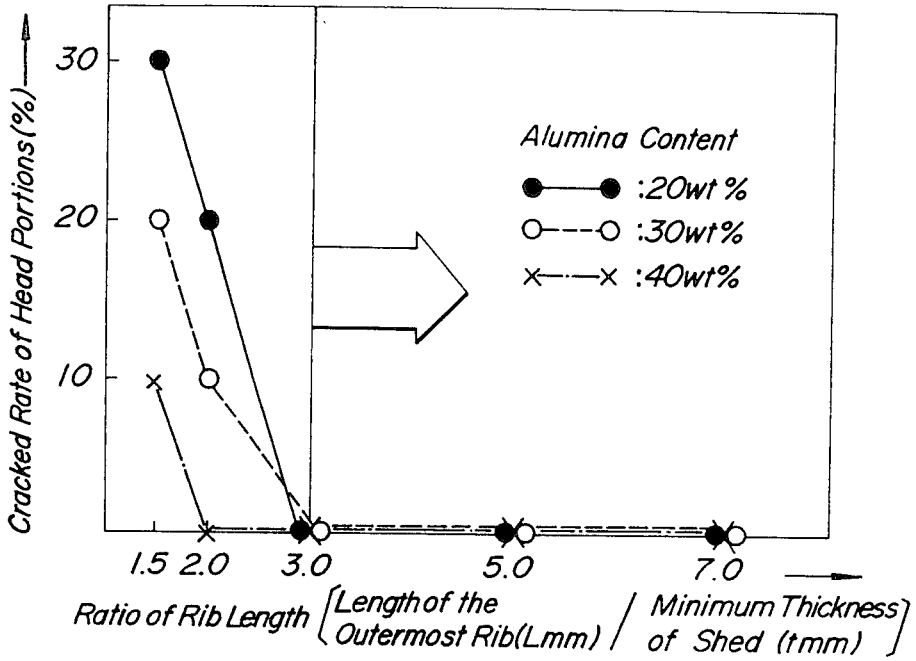
FIG. 9 is a graph showing the relation between the ratio of the height of a rib to the minimum thickness of the shed and the cracked rate of the head portions.

While the minimum thickness of the shed was kept constant and only the length of the outermost rib was varied with respect to the materials of the composition range shown in Table 1, and the profile shown in FIG. 1, the limit in the ratio of the length of the outermost rib to the minimum thickness of the shed at which no cracks extend to the head portion over the edge of the cap when the insulator was shot with a projectile was examined. The above-mentioned shooting test method was used. Tests were carried out by using high power projectiles as in the case of Example 3. The evaluation was carried out based on the above-mentioned cracked rate of the head portion. Table 4 and FIG. 9 show results thereof. As evident from the results of FIG. 9, it was revealed that the ratio of the length of the outermost rib to the minimum thickness of shed is not less than 3, the cracks do not extend to the head portion at all in the shooting with the high power projectiles. The reason is the synergistic effect owing to the combined provision of the thinnest part of the shed and the thickened part. When the ratio of the length of the outermost rib to the minimum thickness of the shed is not less than 3, the above function can be effectively accomplished. Similar tests were carried out with respect to the ratios of the lengths of all the ribs to the thinnest part of the shed and other profiles of the suspension insulators as shown in FIGS. 2 to 4, and substantially the same results could be obtained.

TABLE 4

| Items | Insulators of the present invention | | | | | | | | | | | | | | | | | | | | | | | | |
|---|---|---|---|---|---|---|---|---|---|---|---|---|---|---|---|---|---|---|---|---|---|---|---|---|---|
| Sample No. | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Profile | as shown in FIG. 1 (T/t = 2.0) | | | | | | | | | | | | | | | | | | | | | | | | |
| Minimum thickness of shed (T mm) | 5.0 | | | | | | | | | | | | | | | | | | | | | | | | |
| Length of the outermost rib (L mm) | 7.5 | | | | | | 10.0 | | | | 15.0 | | | | 25.0 | | | | | 35.0 | | | | | |
| L/t | 1.5 | | | | | | 2.0 | | | | 3.0 | | | | 5.0 | | | | | 7.0 | | | | | |
| Alumina content (wt %) | 20 | 30 | 40 | 50 | 60 | 20 | 30 | 40 | 50 | 60 | 20 | 30 | 40 | 40 | 60 | 20 | 30 | 40 | 50 | 60 | 20 | 30 | 40 | 50 | 60 |
| Head portion cracked rate (%) | 30 | 20 | 10 | 0 | 0 | 20 | 10 | 0 | 0 | 0 | 0 | 0 | 0 | 0 | 0 | 0 | 0 | 0 | 0 | 0 | 0 | 0 | 0 | 0 | 0 |
| Total evaluation | ○ | ○ | ○ | ◎ | ◎ | ○ | ○ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |

The present invention is not limited to the above-mentioned Examples, and numerous modifications, variations and changes can be made. For instance, the profiles of the insulator in the above Examples have been explained with respect to a suspension insulator. Needless to say, the present invention can be favorably applied to other profile insulators, for instance, pin insulators.

As evident from the above detailed explanation, since the electrical insulators according to the present invention are provided with the thinnest part at the shed and with a thickened part in the head portion or in the vicinity of the junction between the head portion and the shed, cracks do not extend to the head portion of the insulator, for example, when the insulator is shot with a projectile. Thus, according to the present invention, insulators free from a reduction in mechanical strength and electrical characteristics can be obtained. Therefore, when the insulator is used in power transmission lines, even after being shot with a projectile, the mechanical strength and the electrical insulating properties of the insulator can be maintained, thereby preventing accidents such as line drop and power supply interruption.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A porcelain insulator comprising:

a head portion which is coverable by a cap;

a shed portion including a first side having a plurality of ribs thereon, a second side which has an external surface, and a thickened portion, said shed portion being connected to said head portion, thereby forming a junction at the connection, and said thickened portion being in the vicinity of the junction between the head portion and the shed portion, wherein the thickness of a thinnest portion of the shed portion is between adjacent ribs of said plurality of ribs or between a radially innermost rib and the thickened portion, said thickness being not less than 5 mm, and a thickness of the thickened portion is not less than twice the thickness of the thinnest portion, and said ribs have a length which is at least twice the thickness of the thinnest portion of the shed portion.

2. A porcelain insulator according to claim 1, wherein the thickness of the thickened portion in the vicinity of the junction between the head portion and the shed portion is the thickness from a tip of a projection between a pinhole into which a steel pin can be inserted and fixed and an innermost recess of the shed portion to the external surface of the shed portion.

3. A porcelain insulator according to claim 1, wherein the thickness of the thickened portion in the vicinity of the junction between the head portion and the shed portion is the thickness from the bottom of an innermost recess of the shed portion to the external surface of the shed portion.

4. a porcelain insulator according to claim 1, wherein the thickness of the thickened portion in the vicinity of the junction between the head portion and the shed portion is the thickness of a projection between a pinhole into which a steel pin can be inserted and fixed and an innermost recess of the shed portion.

5. A porcelain insulator according to claim 5, wherein said ribs have a length which is not less than three times the thickness of the thinnest portion of the shed portion.

6. A porcelain insulator according to claim 1, wherein the porcelain of the insulator contains alumina and the content of the alumina is not less than 40% by weight.

* * * * *